US008590748B2

(12) United States Patent
Pouchain et al.

(10) Patent No.: US 8,590,748 B2
(45) Date of Patent: Nov. 26, 2013

(54) COSMETIC PRODUCT DEVICE PRESENTING A DISPENSER ORIFICE

(75) Inventors: Jean-Eudes Pouchain, Bouillanourt la Bataille (FR); Nicolas Mathieu, Paris (FR)

(73) Assignee: Chanel Parfums Beaute, Neuilly sur Seine (FR)

( * ) Notice: Subject to any disclaimer, the term of this patent is extended or adjusted under 35 U.S.C. 154(b) by 0 days.

(21) Appl. No.: 13/389,086

(22) PCT Filed: Jul. 30, 2010

(86) PCT No.: PCT/FR2010/051634

§ 371 (c)(1),
(2), (4) Date: Apr. 6, 2012

(87) PCT Pub. No.: WO2011/015777

PCT Pub. Date: Feb. 10, 2011

(65) Prior Publication Data

US 2012/0187149 A1 Jul. 26, 2012

(30) Foreign Application Priority Data

Aug. 7, 2009 (FR) ..... 09 55578

(51) Int. Cl.
*B67D 1/08* (2006.01)
*B67D 1/16* (2006.01)

(52) U.S. Cl.
USPC ..... 222/148; 222/108

(58) Field of Classification Search
USPC ..... 222/148, 108, 321.3, 562; 220/810, 833
See application file for complete search history.

(56) References Cited

U.S. PATENT DOCUMENTS

| | | | | |
|---|---|---|---|---|
| 3,655,100 | A * | 4/1972 | Markowitz | 222/182 |
| 3,809,300 | A * | 5/1974 | Russell | 222/545 |
| 4,809,887 | A * | 3/1989 | Jupin et al. | 222/207 |
| 5,094,364 | A * | 3/1992 | Knickerbocker | 222/148 |
| 5,105,988 | A * | 4/1992 | Knickerbocker | 222/148 |
| 5,207,785 | A * | 5/1993 | Knickerbocker | 222/148 |
| 5,449,094 | A * | 9/1995 | Behar et al. | 222/321.3 |
| 7,510,102 | B2 * | 3/2009 | Schmitt | 222/148 |
| 8,043,269 | B2 * | 10/2011 | Fourment et al. | 604/257 |

(Continued)

FOREIGN PATENT DOCUMENTS

| | | | |
|---|---|---|---|
| EP | 0 277 893 | A1 | 8/1988 |
| FR | 2 786 075 | A1 | 5/2000 |
| FR | 2 866 819 | A1 | 9/2005 |
| GB | 2 448 788 | A | 10/2008 |
| WO | WO 97/35499 | A1 | 10/1997 |

OTHER PUBLICATIONS

International Search Report issued in International Application No. PCT/FR2010/051634 dated Mar. 16, 2011 (with translation).
International Preliminary Report on Patentability issued in International Application No. PCT/FR2010/051634 dated Mar. 16, 2011.

*Primary Examiner* — Paul R Durand
*Assistant Examiner* — Benjamin R Shaw
(74) *Attorney, Agent, or Firm* — Oliff & Berridge, PLC

(57) ABSTRACT

The cosmetic product device comprises a container presenting an orifice for dispensing a product; and a cap presenting an internal portion in relief, such as a lip, arranged to pass over the orifice while closing the container with the cap, and to lie at a distance from the orifice when the cap closes the container. The cap is arranged in such a manner that while it is keeping the container closed it bears against the orifice and closes it.

13 Claims, 3 Drawing Sheets

(56) References Cited

U.S. PATENT DOCUMENTS

2002/0014434 A1 2/2002 Mathiez
2004/0050871 A1* 3/2004 Delage ..... 222/212
2005/0199655 A1* 9/2005 Petit ..... 222/546
2007/0205233 A1 9/2007 Petit et al.
2008/0217208 A1 9/2008 Mathiez

* cited by examiner

COSMETIC PRODUCT DEVICE PRESENTING A DISPENSER ORIFICE

FIELD OF THE INVENTION

The invention relates to cosmetic product devices comprising a container.

BACKGROUND OF THE INVENTION

Articles are known that contain a cosmetic fluid in a liquid or viscous form for dispensing through the orifice of a nozzle. Means such as a pump act on command to dispense the fluid through the orifice. The assembly may be covered by a cap having the function of avoiding contact between the orifice and elements external to the article. By way of example, a device of this type is described in application EP-0 277 893.

It commonly happens that fluid remains in the nozzle after use. Unfortunately this can lead to several problems.

Firstly, this fraction of fluid forms a site that can become contaminated on contact with the surroundings.

Thereafter, the appearance of the deposit of fluid formed in this way is unattractive next time the user removes the cap in order to obtain the fluid. This applies particularly when the fluid dries out in contact with ambient air. And the deposit may then become mixed with the dose of clean fluid that is dispensed through the orifice.

Furthermore, depending on the formulation corresponding to the fluid used, it can happen that on drying the fluid forms threads that accumulate at the orifice and obstruct it progressively, either completely or in part. As a result dispensing is no longer under full control insofar as the fluid expelled from the orifice may be deflected significantly or indeed may be dispensed in doses that are incomplete.

In order to mitigate those problems, mechanisms have been proposed for internally closing the orifice of the nozzle. Such mechanisms serve in particular temporarily to interrupt any communication between the orifice and the receptacle containing the fluid. Such mechanisms may be piston mechanisms, for example. Nevertheless, such mechanisms are usually of a complicated arrangement and require careful assembly, thereby making them expensive. Furthermore, they require considerable and specific developments and they need to be housed within volumes that are small and that are not always adaptable. Above all, they do not prevent a certain amount of the fluid forming a deposit at the outside of the orifice.

Devices are also known in which the cap itself covers the orifice of the nozzle. That applies in the above-mentioned document. However, such closure causes the deposited fluid to be spread over the nozzle and over the inside face of the cap so that as the device is used an increasing number of times, the fluid accumulates in those locations, and thus in particular on the orifice itself, once more making its appearance relatively unattractive.

OBJECT AND SUMMARY OF THE INVENTION

An object of the invention is to improve cleaning of the nozzle.

To this end, the invention provides a cosmetic product device that comprises:

- a container presenting an orifice for dispensing a product; and
- a cap presenting an internal portion in relief, such as a lip, arranged to pass over the orifice while closing the container with the cap, and to lie at a distance from the orifice when the cap closes the container, the cap being arranged in such a manner that while it is keeping the container closed it bears against the orifice and closes it.

Thus, the portion in relief eliminates from the orifice any product that might project therefrom after use by wiping or scraping it away before the cap reaches the position in which it closes the container. All leftover product projecting from the orifice is thus taken away from the nozzle. Under such circumstances, when the user next removes the cap, the nozzle is found to present an orifice that is free from product and that presents a satisfactory appearance. Furthermore, not only does the cap wipe or scrape the orifice, but it subsequently closes it so as to limit communication between any product situated inside the container and the external environment, thereby preserving the properties of the product. The invention has the effect of further reducing the quantity of product that comes into contact with the external medium and thus of conserving the attractive appearance of the orifice of the nozzle in devices of this type throughout the lifetime of the article.

Preferably, the cap is arranged to close the orifice by means of a shutter of flexible material.

This ensures that the nozzle is properly closed even if the orifice and the shutter do not correspond exactly at rest.

Advantageously, the portion in relief extends at a distance from the free end of the cap.

Thus, wiping or scraping does not take place close to a bottom edge of the cap, but rather inside the cap in a manner that is not visible to the user.

Advantageously, the portion in relief forms a body of revolution about an axis of the cap.

It is thus possible to put the cap into place on the container without requiring any particular angular positioning of one relative to the other about the main axis of the container. For example, the cap may occupy a position that is offset by one-fourth of a turn relative to its original position. Under all circumstances, the portion in relief performs its wiping or scraping operation, thereby keeping the orifice clean.

Preferably, the cap presents at least one cavity contiguous with the portion in relief, there being two such cavities, for example, which cavities preferably extend respectively above and below the portion in relief.

Thus, the cavity constitutes a receptacle that can receive the product that has been removed from the orifice by the portion in relief. This avoids the product from occupying an uncontrolled position inside the cap, from which position it might subsequently fall away or come into contact with the user or with some other portion of the container. When the cavity is a bottom cavity, it receives the product that is obtained as a result of the movement of the cap while being put into place on the container. If the cavity is a top cavity, it receives the fluid that is taken away from the orifice by the portion in relief while the cap is being removed from the container.

Preferably, the cap comprises an outer cover and an internal element housed completely inside the cover and carrying the portion in relief, the cover and the element forming distinct parts.

This provides a wide margin for configuring the cover and the internal element so as to enable them to perform their respective functions. In particular, it is possible for each of these parts to be made of mutually different materials and for each of them to be better adapted to the role that it is to perform.

Advantageously, the internal element is made of a material that is softer than the material of the cover, the internal element being made of elastomer, for example.

Often, the cap performs in particular an esthetic function, insofar as it contributes greatly to the general appearance of the device. For this purpose, the cover may for example be made of a plastics material that is relatively hard and for which it is relatively easy to obtain a good appearance (surface state, optional printing, painting, . . . ). Furthermore, the element carrying the portion in relief may be made of a material that is relatively soft, such as an elastomer, so that the portion in relief is effective in performing its wiping or scraping operation.

Advantageously, the cap includes an insert forming a part that is distinct from the cap and from the internal element, and serving to hold the internal element inside the cap.

This enables the internal element and the cap to be assembled together in relatively simple manner, which is particularly advantageous when these parts are made of different materials.

Advantageously, the device contains a cosmetic fluid that is liquid or pasty.

Provision may be made for the device to include a mechanism for dispensing the fluid, such as a pump.

The invention also provides a method of fabrication a cap for an article of the invention, wherein an insert and an internal element carrying a portion in relief such as a lip are assembled together and then the assembly is inserted into a cover to form the cap in such a manner that the portion in relief forms a portion in relief inside the cap.

BRIEF DESCRIPTION OF THE DRAWINGS

Other characteristics and advantages of the invention appear further from the following description of an embodiment and a variant given as non-limiting examples and with reference to the accompanying drawings, in which.

MORE DETAILED DESCRIPTION

Figure 1:
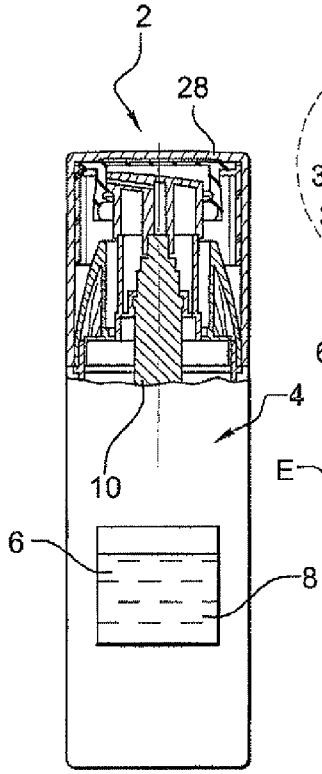
FIG. 1 is a general axial section view of a cosmetic fluid device in an embodiment of the invention.

The figures show an article 2 comprising a device 4 containing a cosmetic fluid 6.

The fluid may be a care product and/or a makeup remover for the face or the body, or it may be a pharmaceutical fluid such as a medicine. It is a fluid that is liquid or pasty and that is dispensed to the user in that form by the article. The fluid may be formed by an aqueous solution, an oily solution, or indeed an emulsion.

The article 2 comprises a body here constituted by a bottle that contains a receptacle 8 of the fluid 6. The receptacle is surmounted by a mechanism 10 for dispensing the fluid through a nozzle 14 extending at the top end of the body. The nozzle presents a fluid dispenser orifice 16. Specifically, the mechanism 10 for dispensing the fluid through the orifice comprises a pump suitable for extracting the fluid from the receptacle and for conveying it to the orifice 16. The pump is of a conventional type and is not described in detail herein. The nozzle 14 is secured to a pushbutton 18 that is mounted to move in sliding relative to the body along a vertical main axis 22 of the article 2. The article is arranged in such a manner that when the user presses on the top face 20 of the button forming the top of the body, that pressure causes the button 18 to move down inside the body and simultaneously causes a dose of fluid to be administered by means of the pump through the orifice 16. The details of the circuit for putting the receptacle 8 into communication with the pump 10 and the orifice are of conventional type and they are not shown.

In this example the pushbutton 18 presents a shape that is generally that of a body of revolution about the axis 22. In particular, it presents a cylindrical side face 24 of circular section in a plane perpendicular to the axis 22. The nozzle projects from said face on one side of the button, the orifice being arranged at the free end of the nozzle, which is formed by a face that is generally cylindrical about the axis 22. Provision is made for the pushbutton 18 to be suitable for turning about the axis 22 relative to the receptacle, but this feature is not essential.

Figure 5:
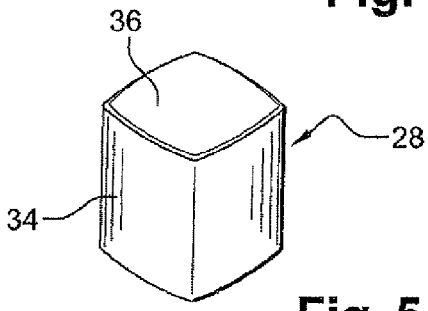
FIGS. 5 and 6 are perspective views of the cover and of the insert of the FIG. 1 device.
Figure 6:
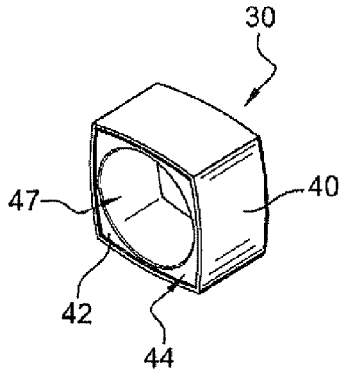
Figure 8:
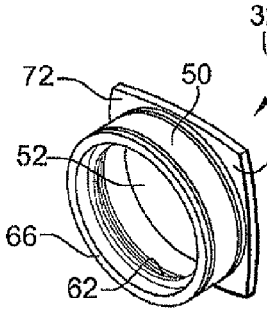
FIGS. 8 and 9 are views analogous to FIGS. 6 and 7 showing the ring of the FIG. 1 device.

The article 2 includes a cap 26 comprising a cover 28, an insert 30, and a ring 32 that are shown respectively in FIGS. 5, 6, and 8 and that form distinct parts that are securely fastened to one another. The insert and the ring extend inside the cover. Only the cover 28 is visible when the cap is observed from the outside, as shown in FIG. 5. This is a cap that is not permanently fastened to the container, being removably mounted thereon. Thus, in order to obtain the fluid, the cap is completely separated from the container.

The cover specifically presents a side wall or skirt 34 of cylindrical shape and of section that is generally square in a plane perpendicular to the axis 22. The skirt is closed at its top end by a plane wall 36. By way of example, the cover is made of a material that is relatively hard, such as a metal or a thermoplastic material.

Figure 7:
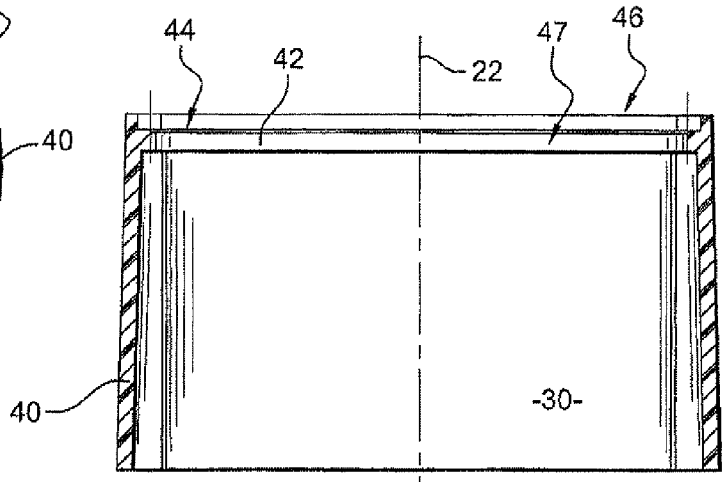
FIG. 7 is an axial section view of the FIG. 6 insert.

With reference to FIGS. 6 and 7, the insert 30 likewise comprises a side wall or skirt 40 that is of generally cylindrical shape about the axis 22, of section that is generally square in a plane perpendicular to the axis. Nevertheless, the shape of this wall is not exactly cylindrical since the insert 30 presents a dimension transversely relative to the axis 22 that tapers on approaching the top of the insert. Close to the top, the insert includes a plane end wall 42 extending in a plane perpendicular to the axis 22. The top face 44 of this wall lies at a distance from the top end 46 of the wall 40. The wall 42 is thus set back a little from said edge. The wall 42 presents a large circular orifice 47 occupying the major fraction of the location of this wall. The insert is made of a material that is relatively hard, e.g. a thermoplastic material.

Figure 9:
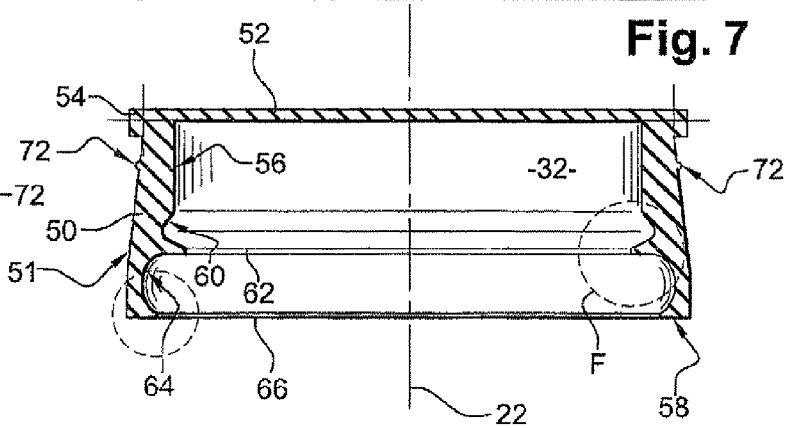

With reference to FIGS. 8 and 9, the ring 32 comprises a side wall or skirt 50 that presents an end face 51 of generally frustoconical shape about the axis 22 and of section that tapers going towards the top end of the ring. This end is formed by an end wall 52 that closes the skirt 50 at its top edge by projecting radially from said edge so that the wall 52 forms a circumferential rim 54 projecting radially from the skirt 50 at said end. In plan view, the wall 52 is generally square in shape so that it presents four corners 72. Apart from the wall 52, the ring 32 is generally in the form of a body of revolution about the axis 22.

Figure 2:
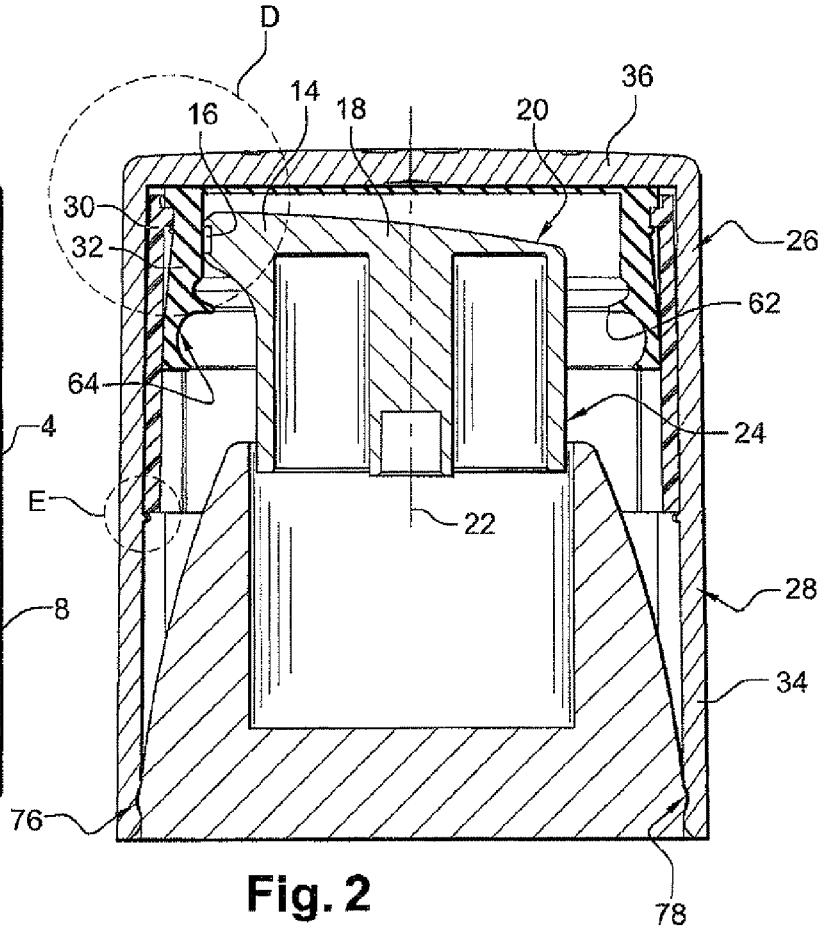
FIG. 2 is a view on a larger scale of the top portion of the FIG. 1 device.

The difference in shape between the walls 40 and 50 can be seen in particular in FIGS. 1 and 2, it being understood that in FIG. 2 the nozzle has been turned through 45° relative to the receptacle and relative to its position in FIG. 1. In FIG. 1, the nozzle extends along a diagonal of the square of the wall 36, whereas in FIG. 2 it extends along a right bisector of the wall.

Although the outside face 51 of the skirt 50 is frustoconical in shape, its inside face 56 presents a shape over a top segment contiguous with the end wall 52 that is cylindrical about the axis 22, and of circular section in a plane perpendicular to said axis.

Below this segment, the inside face presents in succession going from this segment to the bottom end edge 58 of the skirt 50: a top cavity 60; a top lip 62; a bottom cavity 64; and a bottom lip 66; these cavities and portions in relief following one another in that order and being contiguous. The lips 62 and 66 and also the cavities 60 and 64 are all annular in shape, the cavities defining parallel grooves.

The cavity 60 is set back from the cylindrical segment of the face 56 in the direction that is radial relative to the axis 22, i.e. at a distance that is further from the axis than is the segment.

Figure 10:
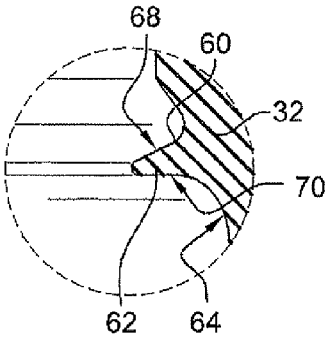
FIG. 10 is a view on a larger scale showing detail F of the FIG. 9 ring.

In contrast, the top lip 62 projects from the cylindrical segment of the face 56, and consequently of the top cavity 60, in the radial direction. As shown on a larger scale in FIG. 10, the lip is defined by two main faces, namely a top face 68 of frustoconical shape with the narrow end of the cone directed downwards, and a bottom face 70 of plane shape that is perpendicular to the axis 22.

Like the cavity 60, the bottom cavity 64 is set back from the segment 56 in the radial direction, and it is set back even further than the cavity 60. The height of this cavity measured parallel to the axis 22 is likewise greater than the height of the cavity 60, and specifically in this example it is equal to twice said height.

The bottom lip 66 is set back from the segment 56 and thus from the lip 62, and also the top cavity 60 in the radial direction. Nevertheless, it projects from the bottom cavity 64 that is contiguous therewith. It presents a shape that is analogous to the shape of the top lip 62.

Figure 4:
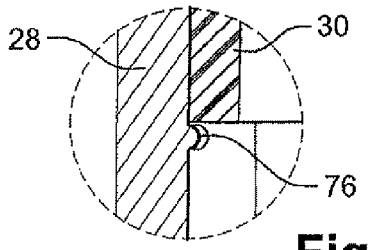

The outside face 51 of the central ring presents an annular portion in relief 72 that can be seen in particular in FIG. 4, with a profile that is circularly arcuate and that projects from said wall.

In this example, the ring 32 is made of a material that is relatively soft, i.e. softer or less hard than the material of the insert 30 and of the cover 28. By way of example it may be an inorganic or an organic elastomer, such as silicone in this example. Otherwise, it is also possible to use a thermoplastic elastomer.

Figure 3:
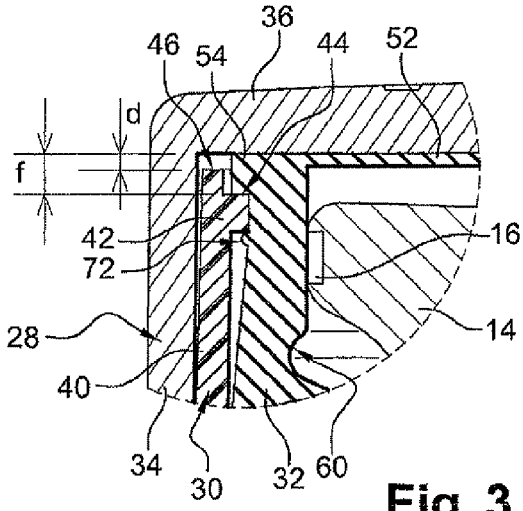
FIGS. 3 and 4 are views on a larger scale showing details D and E of the FIG. 2 device.

As can be seen in particular in FIGS. 2 and 3, the ring 32 is received in the cover 28 in a position such that its top wall 52 is in abutment against the top wall 36 of the cover, making surface contact therewith. The insert 30 is interposed radially via its top segment between firstly the cover on the outside and secondly the ring on the inside. The skirt 50 of the ring presents a shape that may be referred to as being a thimble, and it passes thorough the orifice 47 in the insert so that the wall 42 of the insert bears via its top face 44 in the direction of the axis 22 against the rim 54 of the ring so as to hold the wall 52 pressed against the top 36 of the cover. In order to maintain this configuration, the edge 46 of the insert extends at a non-zero distance d from the wall 36. The rim 54 of the ring is of thickness f that is greater than the distance between the face 44 and the end 46, which distance is equal to the difference f−d.

As shown in FIG. 3, the portion in relief 72 of the thimble extends against the wall 42 of the insert in the axial direction in order to reduce the risk of the insert and the ring separating in the axial direction.

With reference to FIG. 4, the cover 28 presents a similar portion in relief 76 of annular shape that extends radially, projecting from the inside face of the cover. This portion in relief comes to bear against the end edge of the skirt 40 of the insert in order to prevent it from sliding relative to the cover along the direction of the axis 22.

Figure 11:
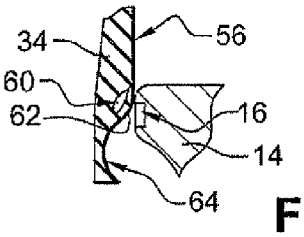
FIGS. 11 and 12 are section views showing how the orifice is wiped by the portion in relief in the FIG. 1 device while the cap is being put into place on the container.
Figure 12:
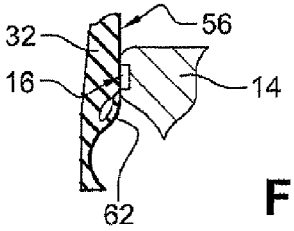
Figure 13:
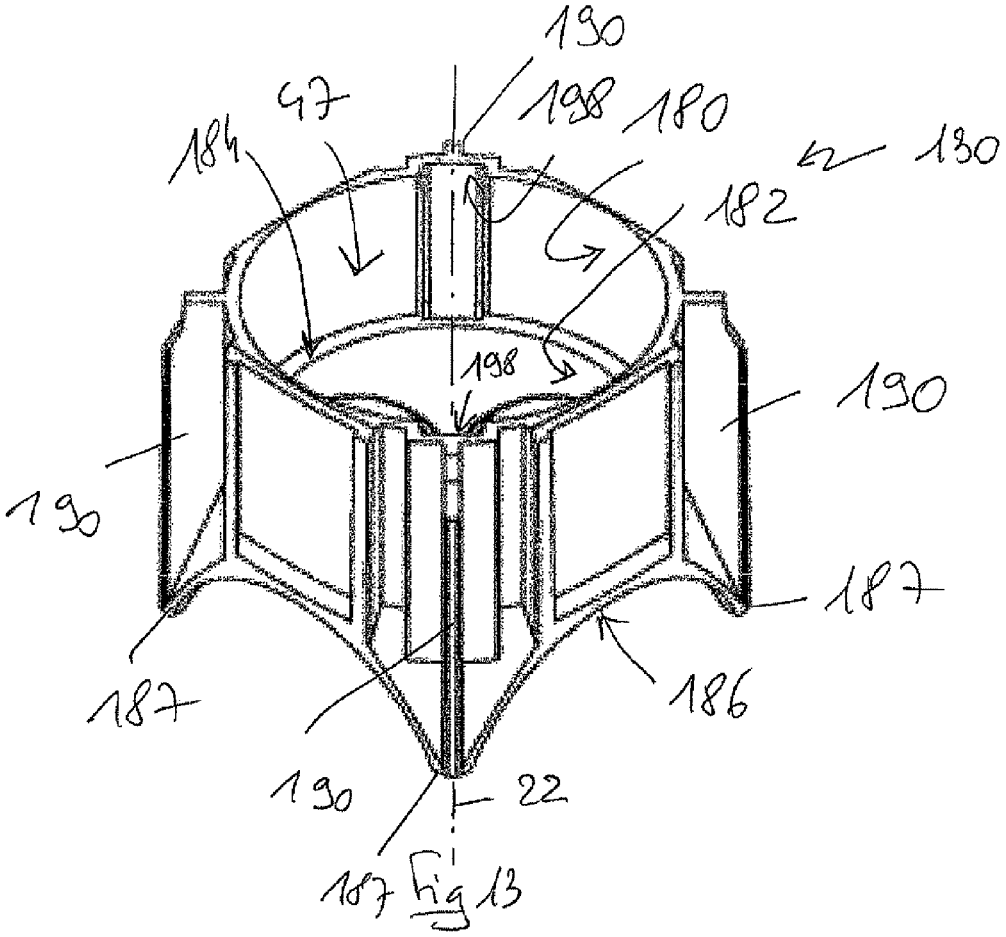
FIGS. 13 and 14 are views analogous to FIGS. 6 and 8 showing a variant embodiment of the device of the invention.
Figure 14:
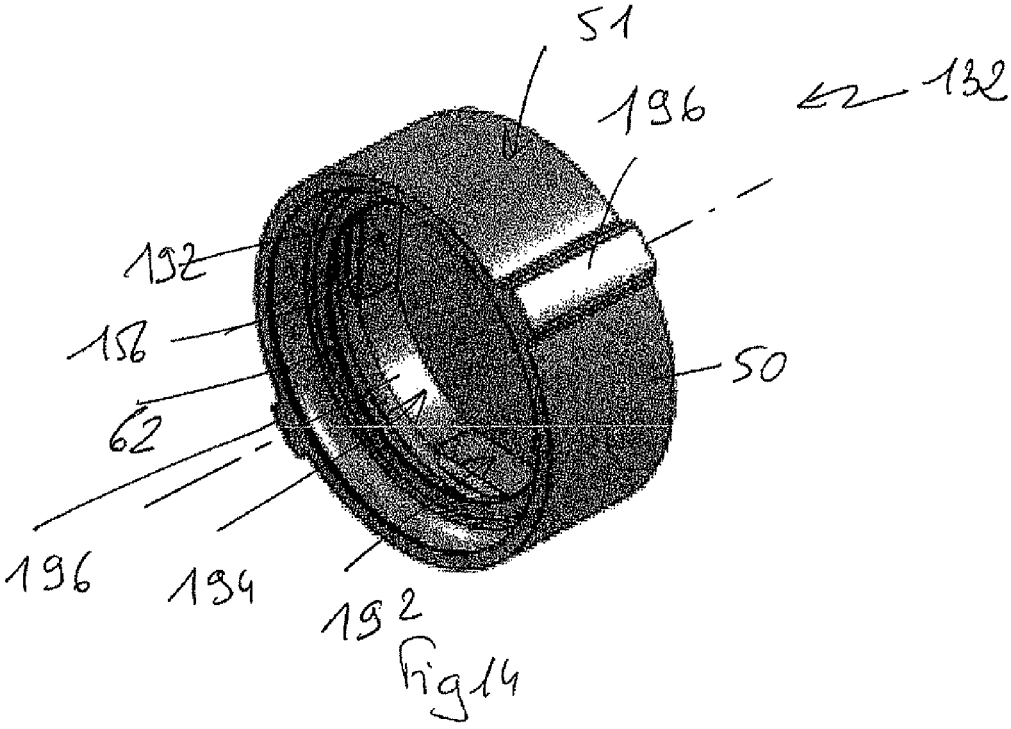

As can be seen in particular in FIGS. 2 and 3, the top lip 62 is spaced apart from the axis 22 by a distance that is shorter than the distance of the orifice 16 from the same axis. As shown in FIGS. 11 and 12, the lip thus interferes with the orifice when the cap goes past the nozzle, either because the cap is being put into place on the container or because it is being taken off.

The cylindrical face 56 of the thimble extends at a distance from the axis 22 that is substantially equal to the distance between the orifice 16 and the same axis, and that is preferably slightly less than said distance. Thus, when the cap is in the position shown in FIG. 2, in which it closes the container, the cylindrical segment is in contact with the nozzle 14, closing its orifice 16 by making surface-on-surface contact therewith. Since the thimble is made of a relatively soft material, it forms a shutter at this location that closes the orifice in effective manner, even if the shape of the orifice at rest is not the same as the shape of the thimble at rest.

The operation of the device is described below. It is assumed that the user dispenses a dose of fluid 6 through the orifice 16 by actuating the pushbutton 18. When the user replaces the cap 26 on the container, the top lip 62, as shown in FIG. 11, presses against the end of the top face of the nozzle, thereby causing said lip to be deformed and flattened against the cylindrical segment 56 by deforming the top cavity 60. As the movement continues, the lip 62 as deformed in this way travels over the orifice 16, wiping or scraping it, thereby eliminating any excess fluid that might be found there. This fluid goes into the bottom cavity 64 when the lip returns to the rest position. FIG. 11 shows the position of the lip on the nozzle at the beginning of this wiping movement, and FIG. 12 shows the same elements at the end of the wiping movement. Once the lip has gone past the nozzle, it returns elastically to its original shape, while the nozzle comes into contact with the cylindrical segment of the face 56 so its orifice is thus closed in sealed manner by the ring. This configuration remains so long as the cap occupies the position shown in FIG. 2, in which it closes the container. Thus, during the movement, the lip initially wipes and scrapes the orifice of the nozzle in order to eliminate excess fluid therefrom, and then after the orifice has gone past the top cavity 60, the cap closes the orifice in leaktight manner because of the relatively soft nature of the material of the thimble.

Specifically, and as shown in FIG. 1, the device 4 carries portions in relief 76 and the cap presents complementary cavities 78 forming means for snap-fastening the cap on the device so as to hold the cap on the body when it is closing the container.

Thereafter, when the user removes the cap from the container, the top lip 62 once more wipes the orifice 16, this time deforming downwards and flattening the bottom cavity 64. Once the cap has been removed from the container, the user sees a nozzle that presents an orifice 16 that is perfectly clean.

It should be observed that the wiping or scraping operations do not require the cover 28 to be deformed, which cover is essentially rigid. The invention does not modify the way the user acts on the cap and does not require the user to perform any particular action. It is during the movement for replacing the cap on the container that the orifice is cleaned and then closed. These actions take place without the user being aware of them. Furthermore, the top lip 62 is at a considerable distance from the bottom edge of the cap. It is housed in the top half of the cap and remains mostly invisible in normal use, unless one looks specifically into the inside of the cap.

It can be seen that the portion in relief 62 is separated from the free edge of the bottom end of the cap by the bottom portion of the inside face of the cover 28, by the bottom portion of the inside face of the insert, and by the bottom lip 66 and the cavity 64 of the ring. It projects radially relative to all of those elements.

The invention does not give rise to any specific constraints on the shape and the materials used for making the article, and in particular the container. Specifically, the skirt 34 may be given at will a shape that is circular or square or some other shape in a plane perpendicular to the axis 22, thereby determining the outside appearance of the cap.

Similarly, the invention does not require the cap to be placed on the container in any particular angular position around the axis 22. On the contrary, it can be seen that because the ring is a body of revolution, the cap may be in any position on the container and still obtain the above-mentioned effects.

In order to make the cap, the ring 32 is initially mounted in the insert 30. For this purpose, the bottom end of the ring is inserted into the orifice 47 of the insert until the rim 54 of the ring bears in the direction of the axis 22 against the wall 42 after it has gone past the portion in relief 72. Thereafter, the resulting assembly is inserted inside the cover so as to press the wall 52 against the top of the cover and so as to cause the insert to go past the portion in relief 76. These assembly operations may be performed with force in order to obtain a tight fit between the three parts so that they do not require any adhesive.

Making the ring out of a material such as an elastomer makes it easier for it to be made by molding. The soft and deformable nature imparted to said part by the material makes it easy to unmold even if it presents shapes that are under-cut. Furthermore, because of this relatively soft material, it is possible to select freely the shape for the face of the nozzle that includes the orifice, since the material of the ring will always adapt to the shape that has been selected. The relative hardness of the material used for constituting the insert 30 encourages robust fastening of the ring inside the cover 28.

A variant embodiment of the device of the invention is described below.

As above, the device comprises a bottle having a cap, each of which presents a section of generally square profile in a plane perpendicular to the vertical main axis 22. Provision may be made for the four faces of the bottle and for the four faces of the cap to bulge outwards.

As above, the nozzle is secured to a pushbutton that is mounted to move in sliding relative to the body along the axis 22. In this variant, and unlike the above variant, the pushbutton is not mounted to be capable of turning about the axis 22 relative to the receptacle. The nozzle of the pushbutton occupies a fixed position about the main axis, pointing perpendicularly towards one of the four faces of the bottle. The free end of the nozzle extends in a rectilinear direction perpendicularly to the main axis 22. The dispenser orifice of the nozzle thus extends in a plane that is parallel to one of the faces of the bottle.

As above, the cap comprises a cover having housed therein an insert 130 and a ring 132 as shown in the figures. Once more, the insert is made of a material that is relatively rigid while the ring is made of flexible material.

As above, the orifice 47 in the insert is defined by a cylindrical face 180 about the axis 22 and of section in a plane perpendicular to said axis that is circular. This is the top inside face of the insert.

In this example, the insert 130 presents a bottom inside face 182 of frustoconical shape coaxially about the axis 22. The top edge of this face is circular in shape. It corresponds to the smallest-diameter section of the face. At this edge, the frustoconical face 182 is separated from the cylindrical face 180 by a step 184 that forms a shoulder that is arranged in such a manner that the frustoconical face 182 at this location projects radially from the cylindrical face 180 relative to the axis 22. Since the outside faces of the insert occupy in general terms a rectangular parallelepiped, the intersection between these faces and the frustoconical face 182 is made up of four arches 186 of hyperbolic shape. These arches form the bottom edge of the bottom inside face 182. The intersections between these arches form points 187 that coincide with the corners of the cap.

The section of the frustoconical face 182 thus tapers going upwards. It forms a centering and guide face when the cap is put back into place on the bottle over the pushbutton. This face guides the pushbutton to press against the center of the cap.

Furthermore, the step 184 prevents the nozzle from catching the bottom edge of the ring when the bottle is closed with the cap.

As above, the ring 132 presents a lip 62 that passes over the orifice of the nozzle so as to wipe it or scrape it during closing.

The device also has means for angularly indexing the ring 132 relative to the insert 130 about the axis 22 when they are mounted one inside the other. Specifically, these are means that act by complementary shapes. The ring 132 thus presents one or more grooves 196 that project radially from the outside face 51 of the skirt. Specifically, this face is cylindrical in shape, presenting a section that is circular in a plane perpendicular to the axis 22. Each groove is straight in shape extending parallel to the axis 22. Specifically, the grooves are two in number and they are diametrically opposite about the axis. In its inside top face 180, the insert 130 presents splines 198 of shape and arrangement complementary to the shape and arrangement of the grooves 196 so as to receive them when the ring is mounted in the insert.

Specifically, the top segment 156 of the inside face of the skirt 50 presents four flats 192 that are regularly distributed around the axis 22 so that the centers of two successive flats are spaced apart by an angle of 90° about said axis. Facing flats are parallel in pairs, whereas successive flats are perpendicular to one another, each flat extending in a plane parallel to the axis 22 with the normal thereto intersecting said axis. The junctions between the edges of successive flats in the circumferential direction take place via four cylindrically-shaped facets 194 presenting profiles that are circularly arcuate in a plane perpendicular to the axis 22.

The four flats 192 coincide around the axis 22 with the four outside faces of the cap, each flat being parallel to one of the faces. These flats locally increase the thickness of the thimble, and above all they provide the nozzle with a plane contact surface that is rectilinear in two directions that are respectively parallel and orthogonal to the axis 22 and rectilinear in a plane that extends radially relative to said axis. This surface is thus parallel to the plane of the free end of the nozzle.

The device is arranged in such a manner that the cap can occupy only four different positions relative to the bottle and that, in each of them, the faces of the bottle and of the cap coincide. Since the nozzle extends in a direction that is perpendicular to one of the main faces of the bottle, the nozzle in each of the four positions is perpendicular to one of the flats 192 with which it comes into contact. The flats thus serve to close the dispenser orifice of the nozzle regardless of the position of the cap on the bottle.

Naturally, numerous modifications may be made to the invention without going beyond the ambit thereof.

Provision may be made for the nozzle not to project from the face 24 so that the orifice lies in the plane of said face.

The container may be given a variety of shapes. Although it is advantageous for some of the parts to be given a shape constituting a body of revolution, that is not essential in the ambit of the invention.

The pump is optional. By way of example, the device could include a tube that is squeezed or flattened in order to expel the fluid. It could be a pot fitted with a movable piston.

Provision may be made for the cap to be screwed onto the body.

The cap may be formed as a single part that incorporates the cover, the insert, and the ring, being fabricated by fuel injection of materials. It is even possible to provide a cap that is a single part that is made in one piece, e.g. being made integrally out of elastomer.

What is claimed is:

1. A cosmetic product device, comprising:

a container including a nozzle having an orifice for dispensing a product, the nozzle protruding on one side of the container, and the orifice being disposed at a free end of the nozzle; and a cap including an internal portion in relief having a lip, wherein the lip is arranged to pass over the orifice when closing the container with the cap, the lip being disposed at a distance from the orifice when the cap closes the container, and the cap is arranged such that when the cap keeps the container closed, the cap bears against the orifice and closes the orifice.

2. The device according to claim 1, wherein the cap is arranged to close the orifice by means of a shutter of flexible material.

3. The device according to claim 1, wherein the flip extends at a distance from a free end of the cap.

4. The device according to claim 1, wherein the flip forms a body of revolution about an axis of the cap.

5. The device according to claim 1, wherein the cap includes at least one cavity contiguous with the lip.

6. The device according to claim 1, wherein the cap includes an outer cover and an internal element housed completely inside the outer cover and carrying the internal portion in relief having the lip, the outer cover and the internal element forming distinct parts.

7. The device according to claim 6, wherein the internal element is made of a material that is softer than the material of the outer cover.

8. The device according to claim 6, wherein the cap includes an insert forming a part that is distinct from the cap and from the internal element, the insert configured to hold the internal element inside the cap.

9. The device according to claim 1, containing a cosmetic fluid that is a liquid or a paste.

10. A method of fabricating a cap for an article according to claim 1, wherein an insert and an internal element carrying the portion in relief having the lip are assembled together and then the assembly of the insert and the internal element is inserted into a cover to form the cap so that the lip forms a portion in relief inside the cap.

11. The device according to claim 1, wherein the cap includes at least two cavities contiguous with the lip and extending above and below the lip.

12. The device according to claim 5, wherein the at least one cavity constitutes a receptacle configured to receive a quantity of product that has been removed from the orifice by the lip.

13. The device according to claim 1, wherein the internal element is made of elastic material.

* * * * *